US008356920B2

(12) United States Patent
Levine

(10) Patent No.: US 8,356,920 B2
(45) Date of Patent: Jan. 22, 2013

(54) LIGHTING DEVICE

(76) Inventor: Jonathan E. Levine, New York, NY (US)

( * ) Notice: Subject to any disclaimer, the term of this patent is extended or adjusted under 35 U.S.C. 154(b) by 972 days.

(21) Appl. No.: 11/954,225

(22) Filed: Dec. 12, 2007

(65) Prior Publication Data

US 2009/0154151 A1 Jun. 18, 2009

(51) Int. Cl.
*F21S 8/00* (2006.01)

(52) U.S. Cl. ..... 362/421; 362/249.03; 362/287; 362/418; 362/419; 362/420

(58) Field of Classification Search ..... 362/199, 362/287, 418–421, 232, 236–48, 249.01–249.03, 362/249.07–249.11
See application file for complete search history.

(56) References Cited

U.S. PATENT DOCUMENTS

| | | | |
|---|---|---|---|
| D104,233 | S | 4/1937 | Arenberg |
| 2,345,235 | A | 3/1944 | Carter, Jr. |
| 2,595,520 | A | 5/1952 | Guerin |
| 2,790,894 | A | 4/1957 | Zingone |
| D222,500 | S | 10/1971 | Gugelot |
| D240,320 | S | 6/1976 | Anderson |
| D264,254 | S | 5/1982 | Heritage |
| D275,062 | S | 8/1984 | Sorko-Ram et al. |
| 4,494,177 | A | 1/1985 | Matthews |
| 4,515,570 | A | 5/1985 | Beltran |
| D293,940 | S | 1/1988 | Lasker |
| 4,751,627 | A | 6/1988 | Usher |
| D299,549 | S | 1/1989 | Macaluso |
| D299,553 | S | 1/1989 | Donato |
| 4,816,969 | A | 3/1989 | Miller |
| D312,136 | S | 11/1990 | Miletich et al. |
| 5,012,394 | A | 4/1991 | Woodward |
| D320,863 | S | 10/1991 | Macaluso |
| 5,169,226 | A | 12/1992 | Friedman |
| 5,265,000 | A | 11/1993 | Lin |
| D346,459 | S | 4/1994 | King |
| D371,857 | S | 7/1996 | Gismondi |
| 5,595,436 | A | 1/1997 | Way, Jr. et al. |
| 5,765,939 | A | 6/1998 | Tanner, Jr. |
| 5,769,529 | A | 6/1998 | Weinstock et al. |
| 5,795,050 | A | 8/1998 | Carter |
| 5,871,274 | A | 2/1999 | Lee et al. |
| 5,911,499 | A * | 6/1999 | Stafford et al. ..... 362/240 |

(Continued)

OTHER PUBLICATIONS

Office Action Dated May 19, 2008 for U.S. Appl. No. 11/510,083 (11 pages).

(Continued)

*Primary Examiner* — Diane Lee
*Assistant Examiner* — Sean Gramling
(74) *Attorney, Agent, or Firm* — Perkins Coie LLP

(57) ABSTRACT

A lighting device is disclosed. The lighting device can include a base, a first light source housing, and a second light source housing. The first and second light source housings each can include a lighting element (e.g., a light-emitting diode). The first and second light source housings can be independently moveable relative to the base. For example, the first light source housing can be rotatable relative to the base around a first axis and a second axis, the first axis being substantially perpendicular to the second axis. Similarly, the second light source housing can be rotatable relative to the base around a third axis and a fourth axis, the third axis being substantially perpendicular to the fourth axis. The base can include a battery compartment and wires electrically connecting the battery compartment to the first and second light source housings.

20 Claims, 11 Drawing Sheets

U.S. PATENT DOCUMENTS

| | | | | |
|---|---|---|---|---|
| D412,040 | S | 7/1999 | Hudak et al. | |
| 5,934,787 | A | 8/1999 | Sharma | |
| 6,146,001 | A | 11/2000 | Cwiakala | |
| 6,206,541 | B1 | 3/2001 | Landamia | |
| D440,673 | S | 4/2001 | Handsaker | |
| D443,713 | S | 6/2001 | Benensohn | |
| D446,321 | S | 8/2001 | Lin | |
| 6,280,042 | B1 * | 8/2001 | Wegrzyn et al. | 362/20 |
| 6,390,652 | B1 | 5/2002 | Echito | |
| 6,406,161 | B1 | 6/2002 | Lin et al. | |
| 6,536,924 | B2 | 3/2003 | Segretto | |
| 6,566,824 | B2 | 5/2003 | Panagotacos et al. | |
| 6,588,920 | B2 | 7/2003 | Agro | |
| 6,619,813 | B1 | 9/2003 | Schnell | |
| 6,641,283 | B1 | 11/2003 | Bohler | |
| D484,270 | S | 12/2003 | Yiu | |
| D485,390 | S | 1/2004 | Stancik et al. | |
| 6,726,502 | B1 | 4/2004 | Hayes | |
| D490,925 | S | 6/2004 | Wilmotte | |
| 6,827,465 | B2 | 12/2004 | Shemitz et al. | |
| 6,877,875 | B2 | 4/2005 | Yu et al. | |
| D506,560 | S | 6/2005 | Oas | |
| D507,373 | S | 7/2005 | Kim | |
| D509,016 | S | 8/2005 | Benghozi | |
| D509,617 | S | 9/2005 | Benghozi | |
| 6,955,442 | B1 | 10/2005 | Chan | |
| 6,979,107 | B1 | 12/2005 | Benensohn | |
| 7,066,619 | B2 | 6/2006 | Waters | |
| D535,262 | S | 1/2007 | Saito et al. | |
| D535,740 | S | 1/2007 | Brown et al. | |
| 7,207,696 | B1 | 4/2007 | Lin | |
| D544,117 | S | 6/2007 | Coushaine | |
| D544,618 | S | 6/2007 | Coushaine | |
| D544,988 | S | 6/2007 | Benensohn | |
| D551,795 | S | 9/2007 | Compton et al. | |
| 7,270,443 | B2 | 9/2007 | Kurtz et al. | |
| D561,925 | S | 2/2008 | Levine | |
| D563,013 | S | 2/2008 | Levine | |
| D563,014 | S | 2/2008 | Levine | |
| D563,582 | S | 3/2008 | Levine | |
| D565,232 | S | 3/2008 | Butler | |
| D567,987 | S | 4/2008 | Khubani | |
| D576,334 | S | 9/2008 | Levine | |
| D576,338 | S | 9/2008 | Levine | |
| D578,246 | S | 10/2008 | Levine | |
| D578,703 | S | 10/2008 | Levine | |
| D581,077 | S | 11/2008 | Levine | |
| D581,569 | S | 11/2008 | Levine | |
| D581,570 | S | 11/2008 | Levine | |
| D581,571 | S | 11/2008 | Levine | |
| D581,572 | S | 11/2008 | Levine | |
| D582,601 | S | 12/2008 | Levine | |
| D585,152 | S | 1/2009 | Levine | |
| D585,578 | S | 1/2009 | Levine | |
| D586,491 | S | 2/2009 | Levine | |
| 7,510,309 | B1 | 3/2009 | Rizzo et al. | |
| 7,562,995 | B1 | 7/2009 | Levine | |
| 7,618,150 | B2 * | 11/2009 | Chien | 362/35 |
| 2001/0009511 | A1 | 7/2001 | Griffiths | |
| 2002/0145876 | A1 | 10/2002 | Juang | |
| 2003/0179572 | A1 | 9/2003 | Schnell | |
| 2004/0240090 | A1 | 12/2004 | Skiver et al. | |
| 2004/0252500 | A1 | 12/2004 | Lin | |
| 2005/0094395 | A1 * | 5/2005 | Rosenberg | 362/249 |
| 2006/0050519 | A1 | 3/2006 | Lin | |
| 2006/0250789 | A1 | 11/2006 | Coushaine | |
| 2007/0070645 | A1 | 3/2007 | Coushaine et al. | |
| 2008/0137326 | A1 | 6/2008 | Levine | |

OTHER PUBLICATIONS

U.S. Appl. No. 29/322,504, filed Aug. 6, 2008, Levine.
U.S. Appl. No. 29/322,506, filed Aug. 6, 2008, Levine.
U.S. Appl. No. 29/322,507, filed Aug. 6, 2008, Levine.
U.S. Appl. No. 29/322,511, filed Aug. 6, 2008, Levine.
U.S. Appl. No. 12/186,875, filed Aug. 6, 2008, Levine.
U.S. Appl. No. 29/323,012, filed Aug. 15, 2008, Levine.
U.S. Appl. No. 29/281,043 Office Action dated Jul. 22, 2008, 13 pages.
U.S. Appl. No. 29/281,044 Office Action dated Jul. 22, 2008, 13 pages.
U.S. Appl. No. 29/281,045 Office Action dated Jul. 22, 2008, 13 pages.

* cited by examiner

LIGHTING DEVICE

FIELD

This disclosure concerns lighting devices, such as battery-powered, mountable lighting devices having two or more maneuverable light source housings connected to a common base.

BACKGROUND

Several varieties of mountable lighting devices are known. For example, U.S. Pat. No. 5,769,529 (US '529) discloses a "light fixture capable of being mounted on a downwardly-facing surface for illuminating a working surface therebelow." US '529, abstract. The lighting device disclosed in US '529 can include multiple lamp assemblies attached to a common base. US '529, FIG. 1. The usefulness of the lighting device disclosed in US '529 is limited, in part, because it must be wired to an external power source. US '529, column 5, lines 55-58 and FIG. 2. In addition, the lamp assemblies are not maneuverable, so the direction of emitted light cannot be adjusted after the lighting device has been installed. US '529, FIG. 1.

Another example of a mountable lighting device is disclosed in U.S. Pat. No. 6,641,283 (US '283). US '283 discloses a lighting device including "a LED module onto which is mounted a plurality of light emitting diodes" and "a mounting base for attaching the LED module to an associated surface, such as the underside of a cabinet." US '283, abstract. In the lighting device disclosed in US '283, the "mounting base [can] have space and connections for attaching several [LED] modules." US '283, column 4, lines 37-42 and FIG. 5. The LED modules are detachable from the mounting base, but they are not maneuverable when attached to the mounting base. US '283, column 4, lines 5-11 and FIG. 2. Thus, the lighting device disclosed in US '283 also provides no mechanism for adjusting the direction of emitted light.

SUMMARY

Disclosed herein are embodiments of a lighting device. Some disclosed embodiments include a base, a first light source housing, and a second light source housing. The first and second light source housings each can include a lighting element (e.g., a light-emitting diode). The lighting elements can be battery-powered. Accordingly, the base can include a battery compartment and wires electrically connecting the battery compartment to the first and second light source housings. A mounting plate (e.g., a releasably fastenable mounting plate) can be included on a side of the base opposite to a side along which the first and second light source housings are positioned.

The first and second light source housings can be independently moveable relative to the base. For example, the first light source housing can be rotatable relative to the base around a first axis and a second axis, the first axis being substantially perpendicular to the second axis. Similarly, the second light source housing can be rotatable relative to the base around a third axis and a fourth axis, the third axis being substantially perpendicular to the fourth axis. In some disclosed embodiments, the first axis and the third axis are substantially parallel and the second axis and the fourth axis are substantially parallel. The second axis and the fourth axis also can be substantially collinear. In embodiments in which the base is elongated, the first axis and the third axis can be substantially perpendicular to a long axis of the base. The first and second light source housings can have substantially round cross sections in planes substantially perpendicular to the first axis and the third axis, respectively.

In some disclosed embodiments, the first light source housing and the second light source housing are positioned along a substantially flat surface of the base. In these embodiments, the first axis, the second axis, the third axis, and the fourth axis can be substantially parallel to the substantially flat surface of the base. Alternatively, the first axis and the third axis can be substantially perpendicular to the substantially flat surface of the base, while the second axis and the fourth axis are substantially parallel to the substantially flat surface of the base. In embodiments in which the first axis and the third axis are substantially perpendicular to the substantially flat surface of the base, the ranges over which the first and second light source housings can be rotated around the first axis and the third axis, respectively, can be restricted.

The first and second light source housings can be partially inset within the base. For example, inset portions of the first and second light source housings can be positioned within the base. These inset portions can be at least partially rounded. In some disclosed embodiments, the first and second light source housings are rotatably suspended between the arms of first and second brackets, respectively. The first and second brackets can be rotatable relative to the base around the first axis and the third axis, respectively. The first light source housing can be rotatable relative to the first bracket around the second axis. Similarly, the second light source housing can be rotatable relative to the second bracket around the fourth axis.

Embodiments of the disclosed lighting device also can include a third light source housing including a third lighting element. Like the first and second light source housings, the third light source housing can be independently moveable relative to the base. For example, the third light source housing can be rotatable relative to the base around a fifth axis and a sixth axis, the fifth axis being substantially perpendicular to the sixth axis. In these embodiments, the first, second, and third light source housings can be arranged in a substantially straight line along a long axis of an elongated base.

DETAILED DESCRIPTION

Throughout this disclosure, the singular terms "a," "an," and "the" include plural referents unless the context clearly indicates otherwise. Similarly, the word "or" is intended to include "and" unless the context clearly indicates otherwise. As used herein the word "connected" does not exclude the presence of one or more intervening elements. The word "rotatable" means capable of pivoting at least five degrees around an axis unless the context clearly indicates otherwise. Directional terms, such as "upper," "lower," "front," "back," "vertical," and "horizontal," are used herein to express and clarify the relationship between various elements. It should be understood that such terms do not denote absolute orientation (e.g., a "vertical" component can become horizontal by rotating the device).

Described herein are embodiments of a lighting device. Some disclosed embodiments are mountable. For example, some disclosed embodiments can be conveniently mounted to the underside of a cabinet to provide lighting for a countertop. Embodiments of the disclosed lighting device also can be battery-powered. In contrast to conventional lighting devices that must be wired to an external power source, a typical consumer can install battery-powered embodiments of the disclosed lighting device without requiring the services of an electrician. Furthermore, battery-powered embodiments of the disclosed lighting device can be installed in locations in which wiring to a central power supply may not be readily available.

Embodiments of the disclosed lighting device can include two or more light source housings connected to a common base. The light source housings can be maneuverable to allow adjustment of the direction of emitted light. This is useful for a variety of applications. For example, the angle of light each light source housing emits can be adjusted to focus light on one or more work areas without moving the entire device. The ability to adjust the angles of emitted light also facilitates targeted accent lighting.

FIGS. 1-9 illustrate one embodiment of the disclosed lighting device. The illustrated lighting device 1000 includes a base 1002 and three light source housings 1004. Each light source housing 1004 includes a window 1006 that is dome-shaped and encloses four lighting elements 1008. The light source housings 1004 are movable in a swivel-like manner in response to hand pressure around the perimeters of the windows 1006. Each of the light source housings 1004 is independently rotatable relative to the base 1002 around substantially any axis parallel to the top surface 1010 of the base. Thus, each light source housing 1004 can be aimed at substantially any point within a circular area on a surface parallel to and directly opposing the top surface 1010 of the base 1002.

Figure 7:
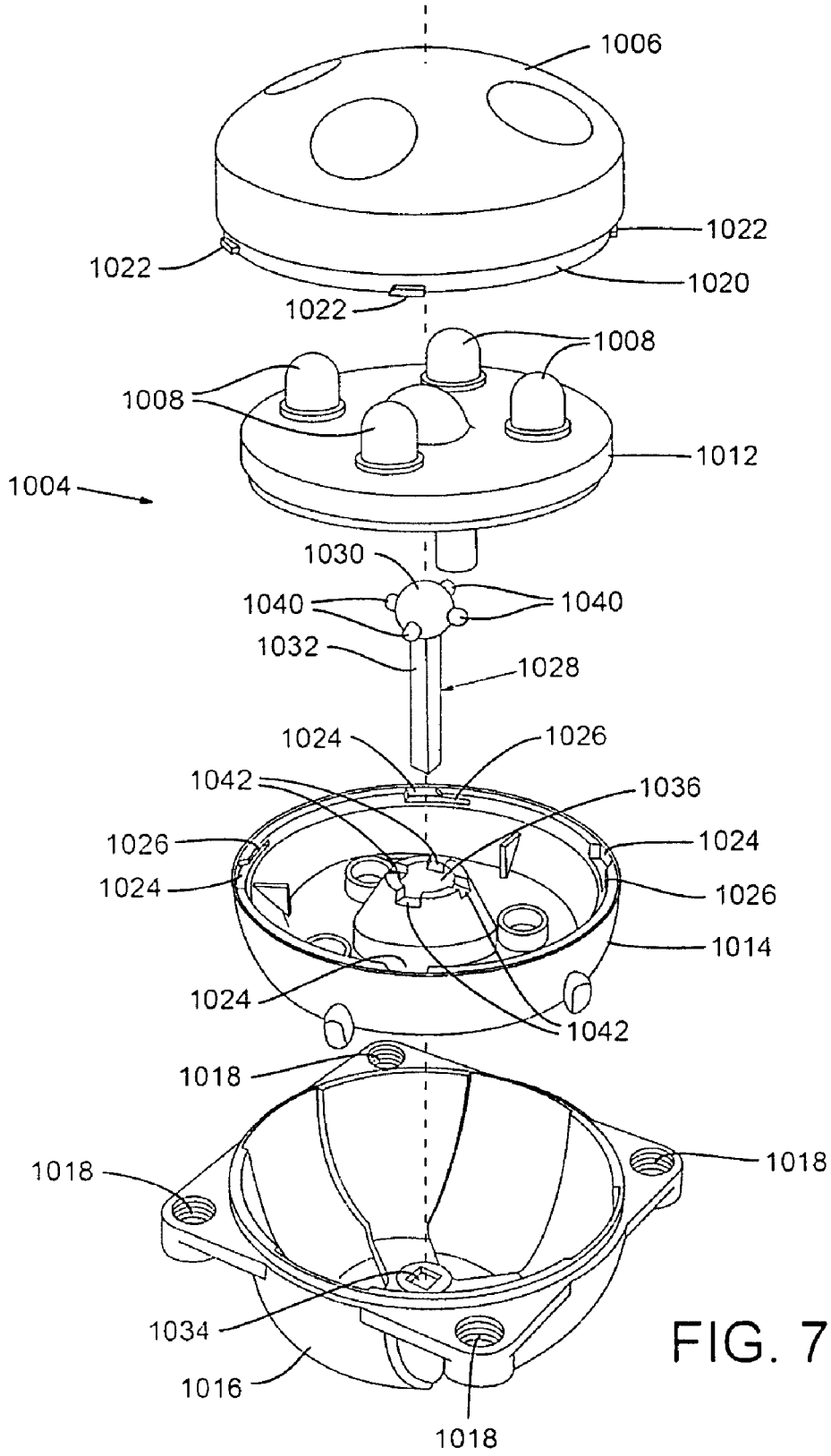
FIG. 7 is an exploded perspective view of one of the light source housings and associated components of the embodiment shown in FIG. 1, as viewed from the top and one side thereof.
Figure 8:
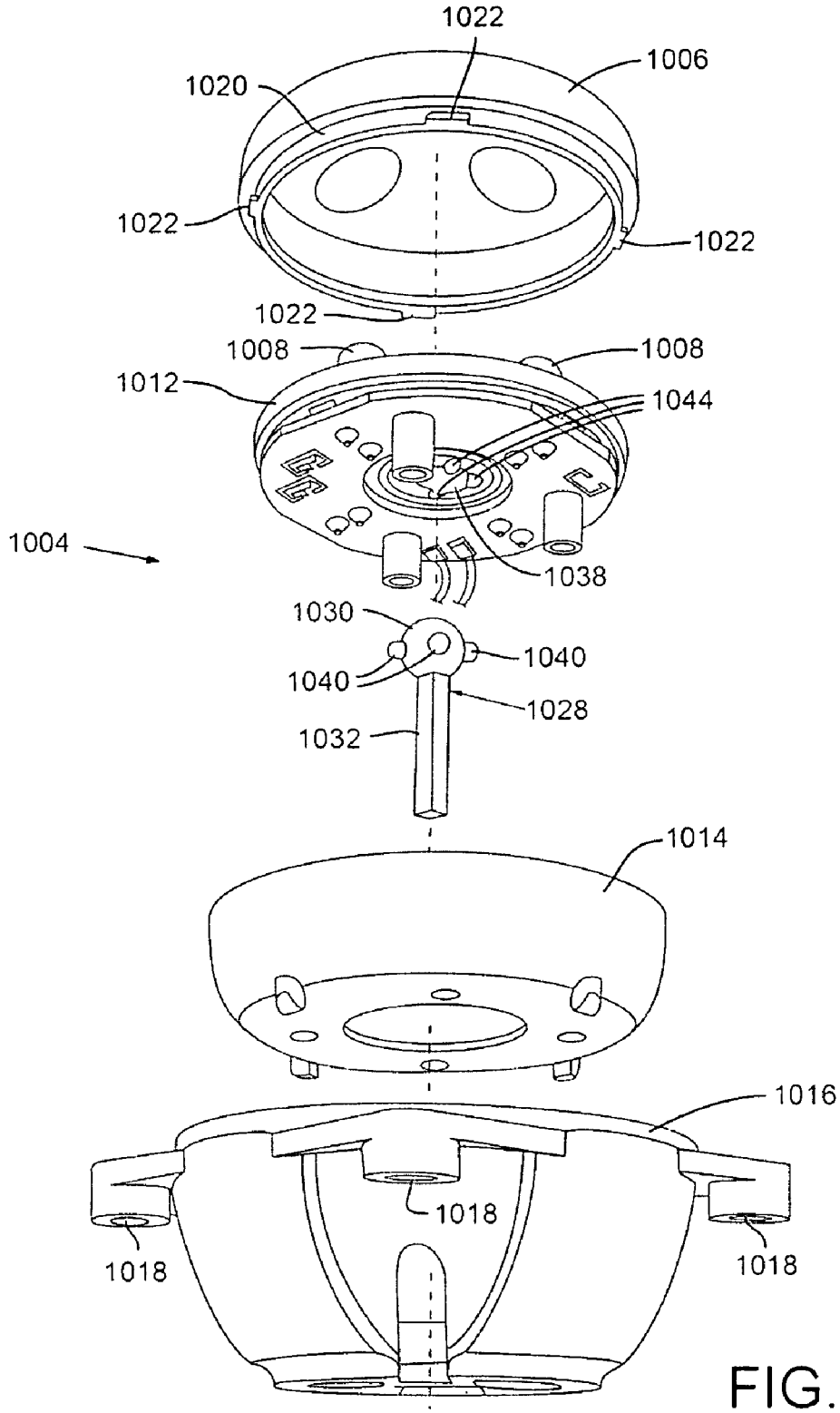
FIG. 8 is an exploded perspective view of one of the light source housings and associated components of the embodiment shown in FIG. 1, as viewed from the bottom and one side thereof.

FIGS. 7 and 8 are exploded perspective views at different angles showing one of the light source housings 1004 and associated components. The illustrated light source housing 1004 includes the window 1006, a backing plate 1012 (on which the lighting elements 1008 are mounted), and an inside swivel dish 1014. Together, the elements of the light source housing 1004 are rotatable relative to an outside swivel dish 1016. When assembled, screws (not shown) extend through outside swivel dish screw holes 1018 in the outside swivel dish 1016 and into screw-receiving posts (not shown) within the base 1002 to secure the outside swivel dish to the base 1002. Additional screws (not shown) attach the inside swivel dish 1014 to the backing plate 1012. The window 1006 includes a lip 1020 with projections 1022 that allow the window to be secured to the inside swivel dish 1014. To attach the window 1006 to the inside swivel dish 1014, the projections 1022 are aligned with rim openings 1024 in the inside swivel dish. The window 1006 then is pressed downward so that the projections 1022 pass through the rim openings 1024 and rotated to lock the projections within channels 1026 adjacent to the rim openings.

A swivel arm 1028 creates a rotatable connection between the light source housing 1004 and the outside swivel dish 1016. The swivel arm 1028 includes a head 1030 and a stem 1032 with a square-shaped cross section along its height. When the light source housing 1004 is assembled, the bottom end of the stem 1032 fits within a square hole 1034 in the outside swivel dish 1016. A screw (not shown) extends through the square hole 1034 and into the bottom end of the stem 1032 to secure the swivel arm 1028 to the outside swivel dish 1016. The head 1030 of the swivel arm 1028 is positioned between a support opening 1036 (as shown in FIG. 7) in the inside swivel dish 1014 and a rounded recess 1038 (as shown in FIG. 8) in the backing plate 1012. The head 1030 of the swivel arm 1028 includes four nubs 1040. These nubs 1040 are aligned with lower notches 1042 (as shown in FIG. 7) around the support opening 1036 of the inside swivel dish 1014 and upper notches 1044 (as shown in FIG. 8) around the rounded recess 1038 of the backing plate 1012. When the light source housing 1004 is assembled, the nubs 1040 fit within slots formed between the lower and upper notches 1042, 1044.

The light source housing 1004 is rotatable on the head 1030 of the swivel arm 1028. Due to the slots formed between the lower and upper notches 1042, 1044, the nubs 1040 do not interfere with rotation of the light source housing 1004 around substantially any axis parallel to the top surface 1010 of the base 1002. Such rotation causes the slots to move substantially vertically around the nubs 1040. The nubs 1040, however, prevent significant horizontal movement of the slots. This prevents the light source housing 1004 from significantly rotating around an axis perpendicular to the top surface 1010 of the base 1002. In addition, the square cross sectional shapes of the stem 1032 and the square hole 1034 prevent the swivel arm 1028 from rotating relative to the outside swivel dish 1016 around an axis perpendicular to the top surface 1010 of the base 1002.

Figure 1:
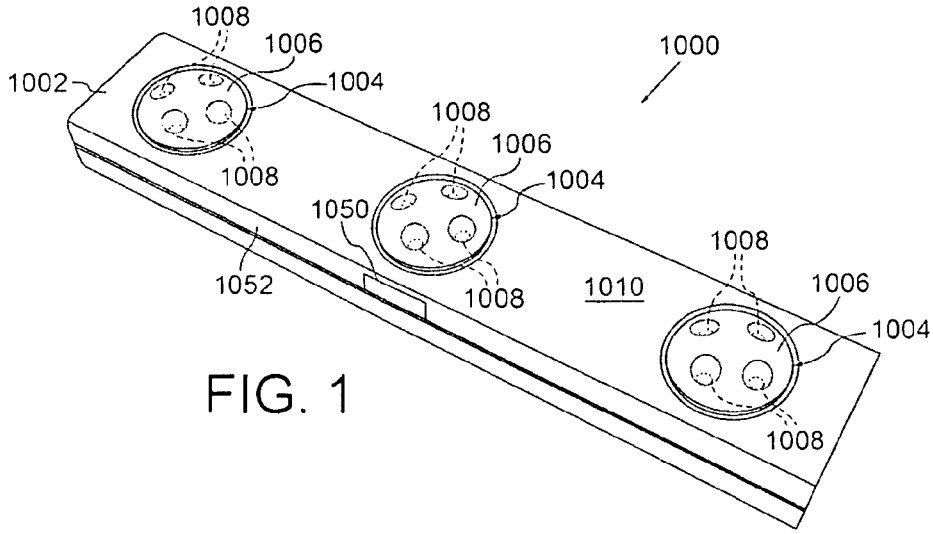
FIG. 1 is a perspective view of a first embodiment of the disclosed lighting device, as viewed from the top and one side thereof.
Figure 2:
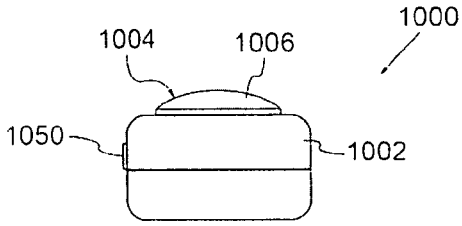
FIG. 2 is an end elevation view of the embodiment shown in FIG. 1.
Figure 3:
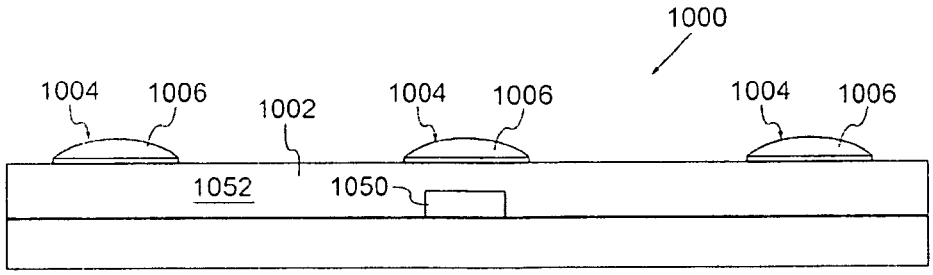
FIG. 3 is a front elevation view of the embodiment shown in FIG. 1.
Figure 4:
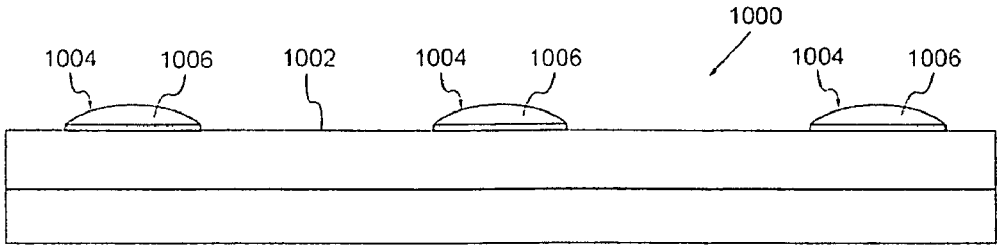
FIG. 4 is a back elevation view of the embodiment shown in FIG. 1.
Figure 5:
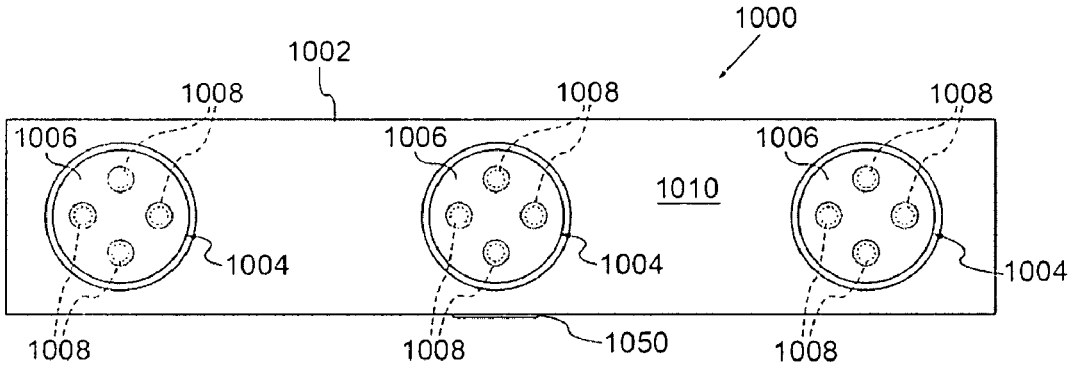
FIG. 5 is a top plan view of the embodiment shown in FIG. 1.
Figure 6:
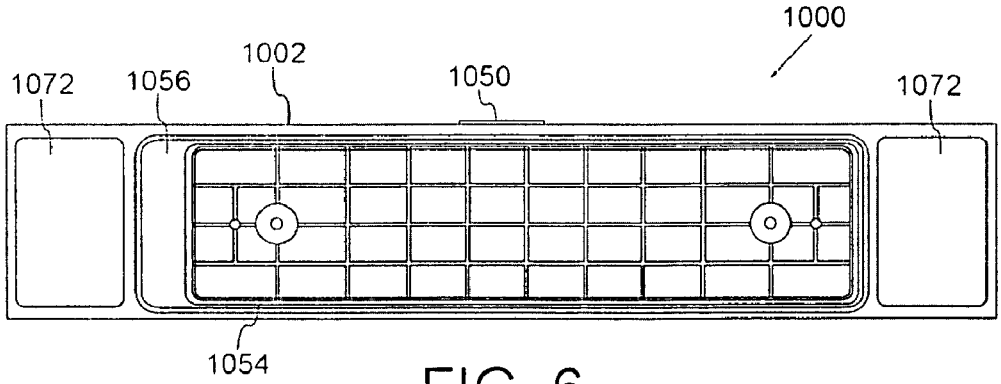
FIG. 6 is a bottom plan view of the embodiment shown in FIG. 1.
Figure 9:
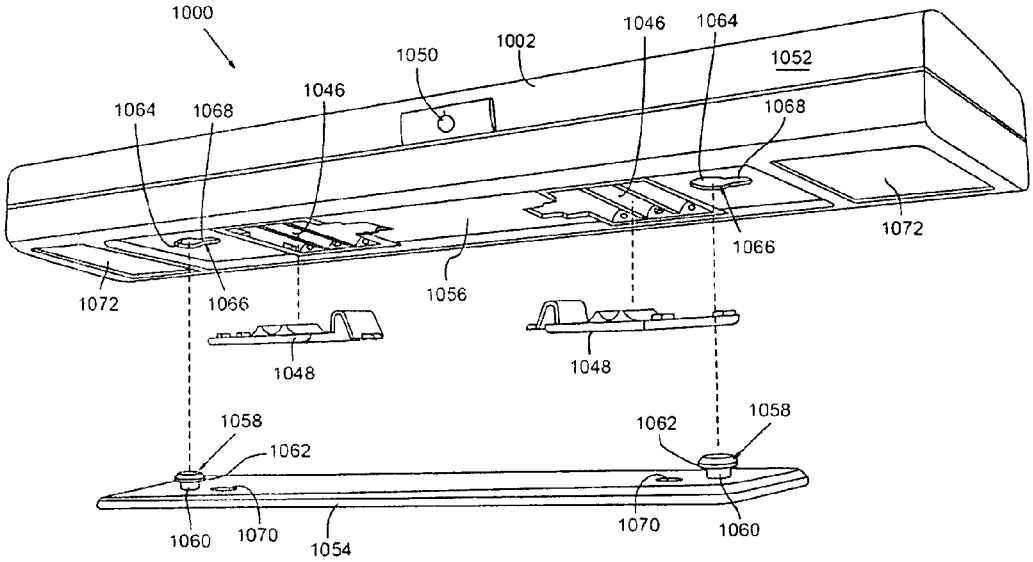
FIG. 9 is an exploded perspective view of the base of the embodiment shown in FIG. 1, as viewed from the bottom and one side thereof.
Figure 10:
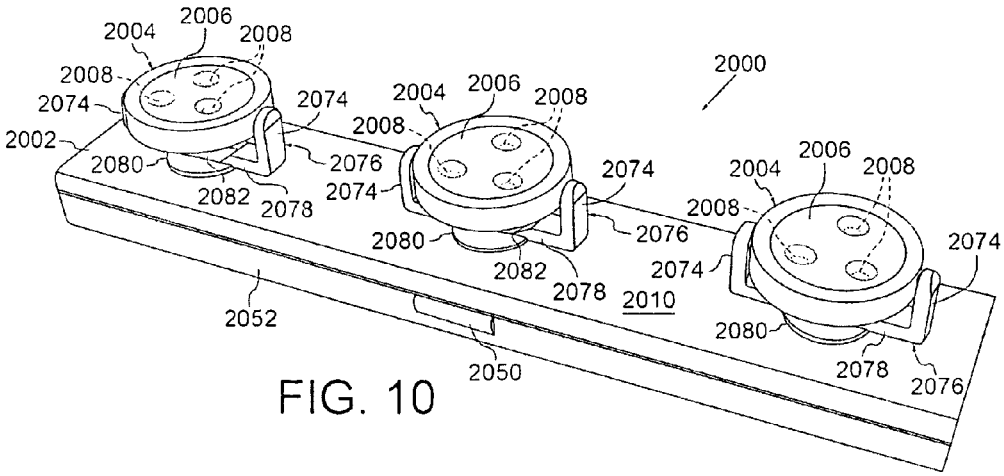
FIG. 10 is a perspective view of a second embodiment of the disclosed lighting device, as viewed from the top and one side thereof.
Figure 11:
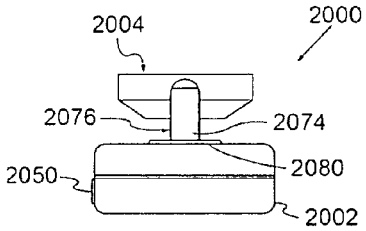
FIG. 11 is an end elevation view of the embodiment shown in FIG. 10.
Figure 12:
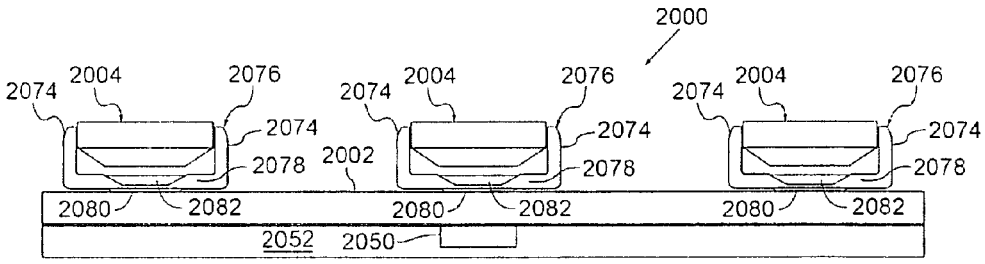
FIG. 12 is a front elevation view of the embodiment shown in FIG. 10.
Figure 13:
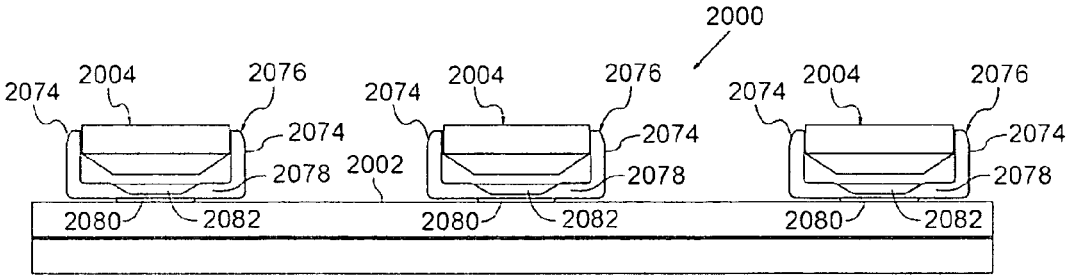
FIG. 13 is a back elevation view of the embodiment shown in FIG. 10.
Figure 14:
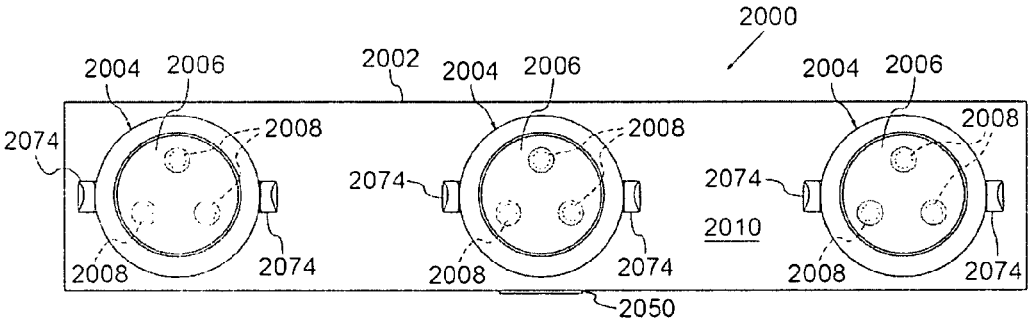
FIG. 14 is a top plan view of the embodiment shown in FIG. 10.
Figure 15:
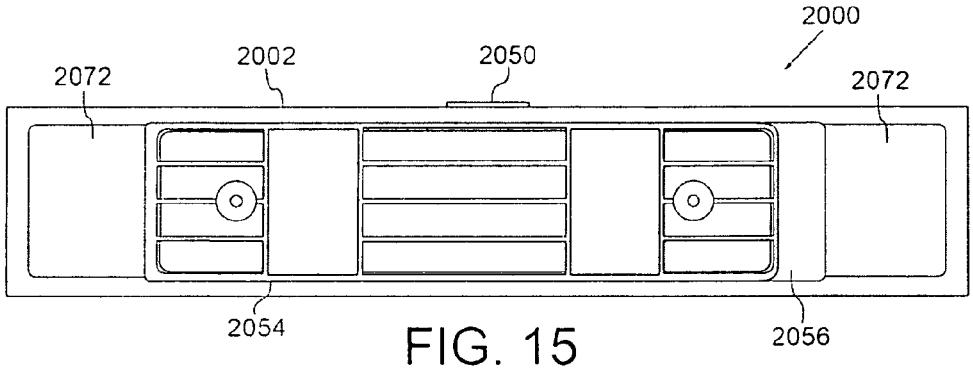
FIG. 15 is a bottom plan view of the embodiment shown in FIG. 10.

FIG. 9 is an exploded perspective view of the base 1002 of the lighting device 1000 shown in FIG. 1. The base 1002 includes two battery compartments 1046. Two detachable battery compartment covers 1048 enclose the battery compartments 1046. Within the base 1002, wires (not shown) extend from the battery compartments 1046 to the light source housings 1004. A power button 1050 located on a front surface 1052 of the base 1002 controls the flow of electricity between the battery compartments 1046 and the light source housings 1004.

Below the battery compartment covers 1048, a mounting plate 1054 is positioned within a mounting plate recess 1056. Two posts 1058 allow the mounting plate 1054 to be readily attached to or detached from the base 1002. Each of the posts 1058 includes a neck 1060 and a flanged head 1062. To attach the mounting plate 1054 to the base 1002, the posts 1058 are inserted into wide portions 1064 of post holes 1066 in the base. The mounting plate 1054 then is moved sideways to shift the necks 1060 of the posts 1058 into narrow portions 1068 of the post holes 1066. The flanged heads 1062 of the posts 1058 do not fit through the narrow portions 1068 of the post holes 1066, so the mounting plate 1054 is securely held in place. To detach the mounting plate 1054 from the base 1002, the mounting plate can be moved sideways in the opposite direction until the flanged heads 1062 of the posts 1058 move back into alignment with the wide portions 1064 of the post holes 1066.

In a typical installation, the mounting plate 1054 is permanently connected to a surface, such as a wall or the underside of a cabinet. Mounting screws (not shown) can be installed through mounting holes 1070 in the mounting plate 1054 to form this connection. The remainder of the lighting device 1000 then can be attached to the mounting plate 1054 via the interlocking posts 1058 and post holes 1066. When an end user requires access to the battery compartments 1046, the base 1002 can be readily detached from the mounting plate 1054 without the need to break any permanent connection between the lighting device 1000 and the surface to which it is installed. The lighting device 1000 also can be used without the mounting plate 1054. For example, fastening material (e.g., adhesive material, magnetic material, or hook-and-loop material) can be positioned in fastening material recesses 1072 on either side of the mounting plate recess 1056. This fastening material can be used to directly connect the lighting device 1000 to a mounting surface.

FIGS. 10-16 illustrate a second embodiment of the disclosed lighting device. The first digit of each reference number shown in FIGS. 10-16 is "2." The final three digits of the reference numbers shown in FIGS. 10-16 are identical to the final three digits of the reference numbers shown in FIGS. 1-9 for similar or identical elements. Similar to the lighting device 1000, the lighting device 2000 includes a base 2002 and three light source housings 2004. Also similar to the lighting device 1000, each of the light source housings 2004 of the lighting device 2000 is independently maneuverable relative to the base 2002. The mechanism by which the light source housings 2004 of the lighting device 2000 move relative to the base 2002, however, is considerably different than the mechanism by which the light source housings 1004 of the lighting device 1000 move relative to the base 1002.

The light source housings 2004 of the lighting device 2000 are disk-shaped with substantially flat windows 2006 each enclosing three lighting elements 2008. Each of the light source housings 2004 is rotatably suspended between two arms 2074 of a U-shaped bracket 2076. The arms 2074 of the U-shaped brackets 2076 extend vertically from opposite sides of lateral bars 2078. The lateral bars 2078 are secured to rotation cylinders 2080 inset into the top surface 2010 of the base 2002. The rotation cylinders 2080 are rotatably connected to the base 2002.

Each of the light source housings 2004 is rotatable around an axis passing through the two points at which the light source housing is connected to the arms 2074 of the U-shaped bracket 2076. This axis is substantially parallel to the top surface 2010 of the base 2002. Side recesses 2082 on either side of each lateral bar 2078 prevent the lateral bars from obstructing rotation of the light source housings 2004 around this axis. Each assembly of a light source housing 2004, a U-shaped bracket 2076, and a rotation cylinder 2080 is rotatable around an axis substantially perpendicular to the top surface 2010 of the base 2002. Rotation around this axis also rotates the axis passing through the two points at which the light source housing 2004 is connected to the arms 2074 of the U-shaped bracket 2076. Thus, the combination of rotation around the around the axis passing through the two points at which the light source housing 2004 is connected to the arms 2074 of the U-shaped bracket 2076 and the axis substantially perpendicular to the top surface 2010 of the base 2002 allows the light source housing 2004 to be rotated around substantially any axis substantially parallel to the top surface 2010 of the base 2002. As with the light source housings 1004 of the lighting device 1000, each light source housing 2004 of the lighting device 2000 can be aimed at substantially any point within a circular area on a surface parallel to and directly opposing the top surface 2010 of the base 2002.

Figure 16:
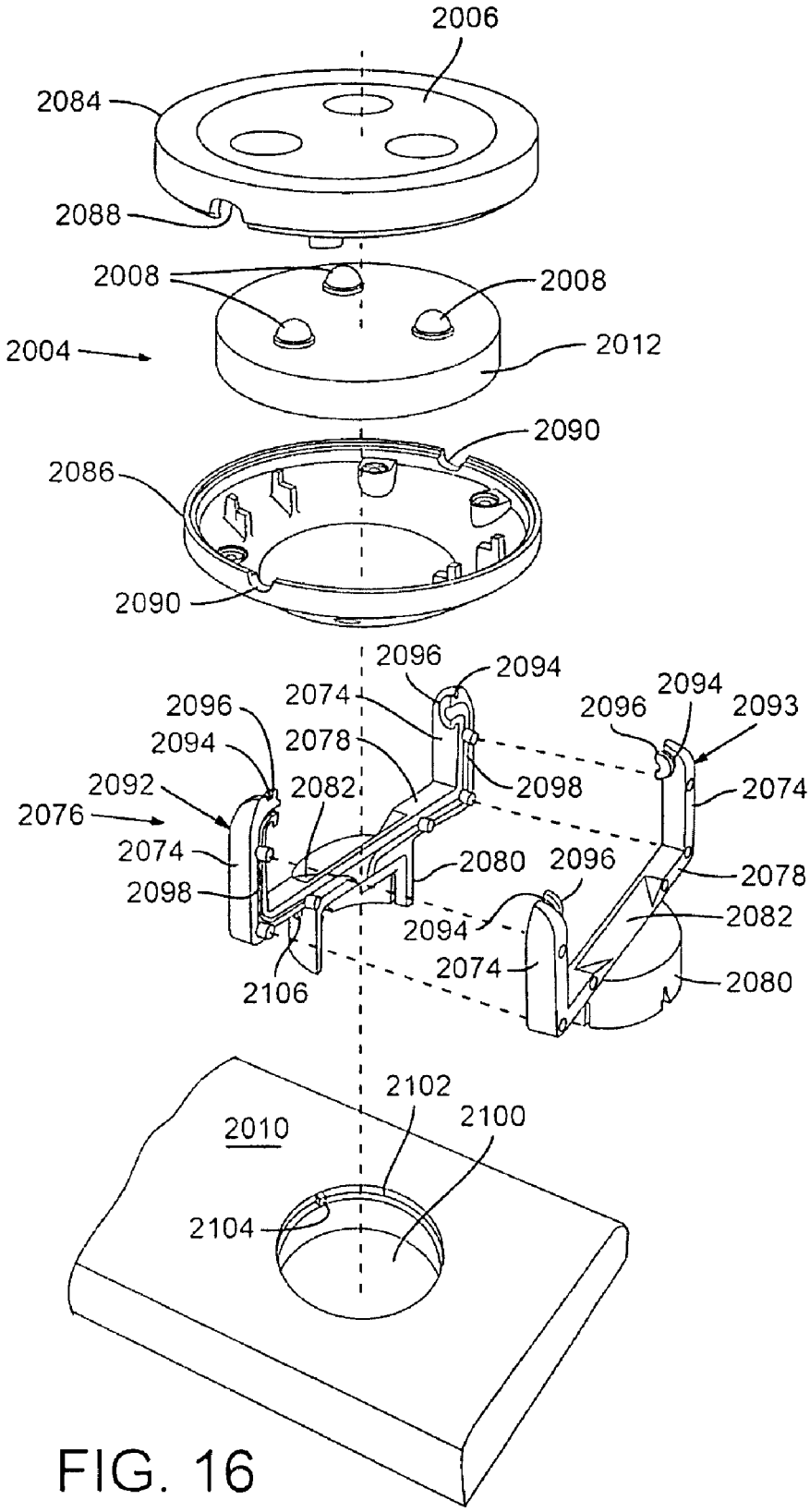
FIG. 16 is an exploded perspective view of one of the light source housings and associated components of the embodiment shown in FIG. 10, as viewed from the top and one side thereof.
Figure 17:
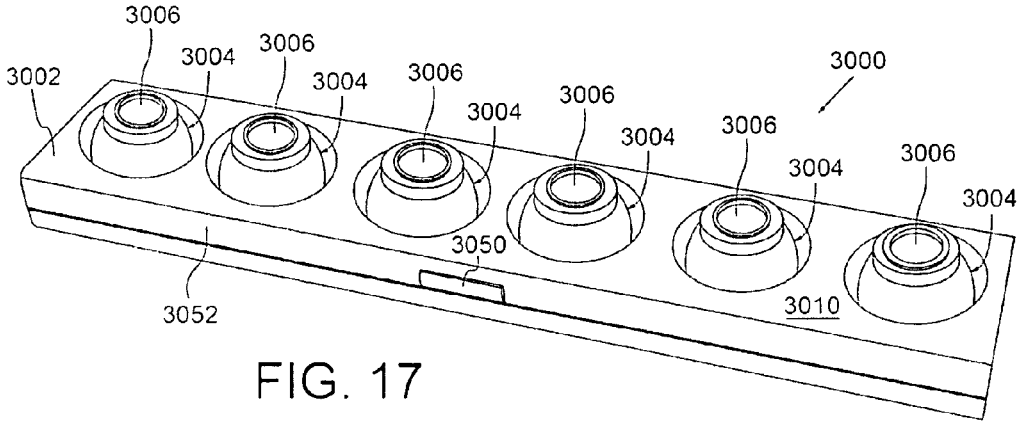
FIG. 17 is a perspective view of a third embodiment of the disclosed lighting device, as viewed from the top and one side thereof.
Figure 18:
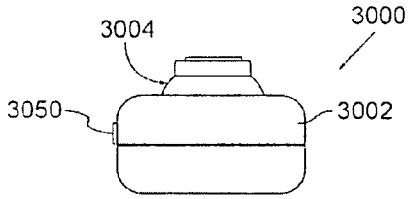
FIG. 18 is an end elevation view of the embodiment shown in FIG. 17.
Figure 19:
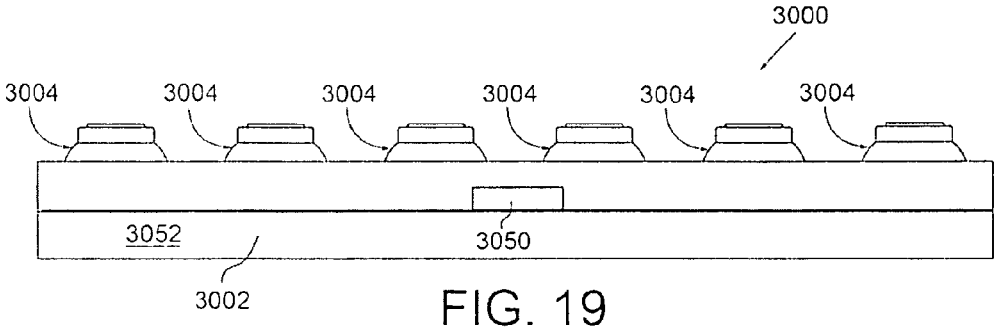
FIG. 19 is a front elevation view of the embodiment shown in FIG. 17.
Figure 20:
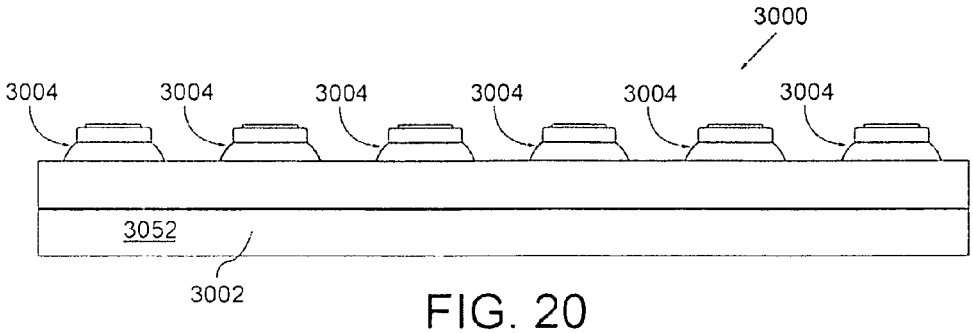
FIG. 20 is a back elevation view of the embodiment shown in FIG. 17.
Figure 21:
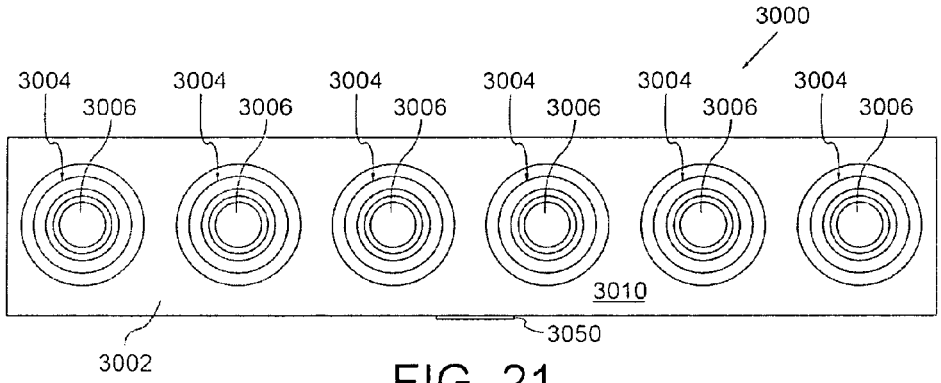
FIG. 21 is a top plan view of the embodiment shown in FIG. 17.
Figure 22:
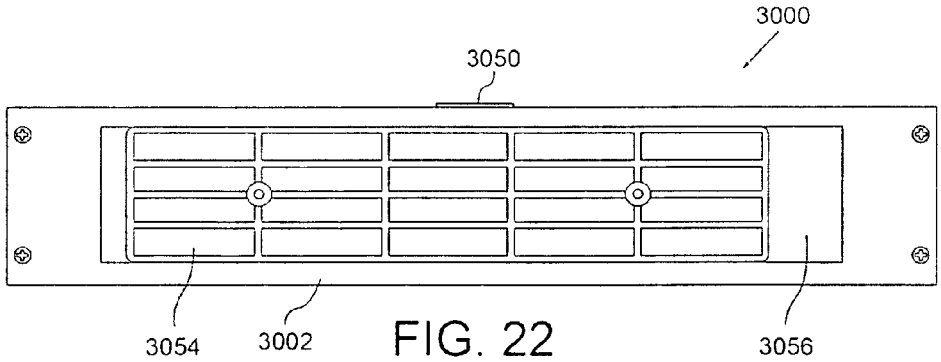
FIG. 22 is a bottom plan view of the embodiment shown in FIG. 17.

FIG. 16 is an exploded perspective view showing one of the light source housings 2004 and associated components. As shown in FIG. 16, the window 2006 is fixed within an upper shell 2084. The upper shell 2084 and a lower shell 2086 come together to enclose the backing plate 2012 and the lighting elements 2008. The upper shell 2084 includes two upper arm-opening halves 2088 (one shown in FIG. 16). The upper arm-opening halves 2088 align with lower arm-opening halves 2090 on the lower shell 2086 to form arm openings on either side of the light source housing 2004. The U-shaped bracket 2076 is split into a first U-shaped bracket section 2092 and a second U-shaped bracket section 2093. When the light source housing 2004 is assembled with the U-shaped bracket 2076, edges around the upper and lower arm-opening halves 2088, 2090 fit into arm channels 2094 on each arm 2074 of the U-shaped bracket. Arm flanges 2096 adjacent to the arm channels 2094 help to hold the edges around the upper and lower arm-opening halves 2088, 2090 within the arm channels.

Wire channels 2098 run along the inside of the U-shaped bracket 2076 to allow wires (not shown) to pass between the base 2002 and the light source housing 2004. Below the lateral bar 2078 of the U-shaped bracket 2076, the rotational cylinder 2080 extends into a rotational cylinder opening 2100 in the base 2002. A recessed rim 2102 extends around the top portion of the rotational cylinder opening 2100. The recessed rim 2102 includes a rim projection 2104. A corresponding arm projection 2106 is positioned on the U-shaped bracket 2076 in a corner between the lateral bar 2078 and the rotational cylinder 2080. As the U-shaped bracket 2076 is rotated around an axis perpendicular to the top surface 2010 of the base 2002, the rim projection 2104 eventually blocks the arm projection 2106. This prevents the U-shaped bracket 2076 from rotating through more than one full revolution around the axis perpendicular to the top surface 2010 of the base 2002.

FIGS. 17-23 illustrate a third embodiment of the disclosed lighting device. The first digit of each reference number shown in FIGS. 17-23 is "3." The final three digits of the reference numbers shown in FIGS. 17-23 are identical to the final three digits of the reference numbers shown in FIGS. 1-16 for similar or identical elements. Similar to the lighting device 1000 and the lighting device 2000, the lighting device 3000 includes light source housings 3004 that are independently maneuverable relative to a base 3002. The mechanism by which the light source housings 3004 of the lighting device 3000 move relative to the base 3002 is considerably different than the mechanism by which the light source housings 1004 of the lighting device 1000 move relative to the base 1002 and the mechanism by which the light source housings 2004 of the lighting device 2000 move relative to the base 2002.

The light source housings 3004 of the lighting device 3000 are rounded with convex windows 3006 each enclosing one lighting element 3008. The light source housings 3004 are movable in a swivel-like manner in response to hand pressure. Each of the light source housings 3004 is independently rotatable relative to the base 3002 around substantially any axis parallel to a top surface 3010 of the base. Thus, as with the light source housings 1004 of the lighting device 1000 and the light source housings 2004 of the lighting device 2000, each light source housing 3004 can be aimed at substantially any point within a circular area on a surface parallel to and directly opposing the top surface 3010 of the base 3002.

Figure 23:
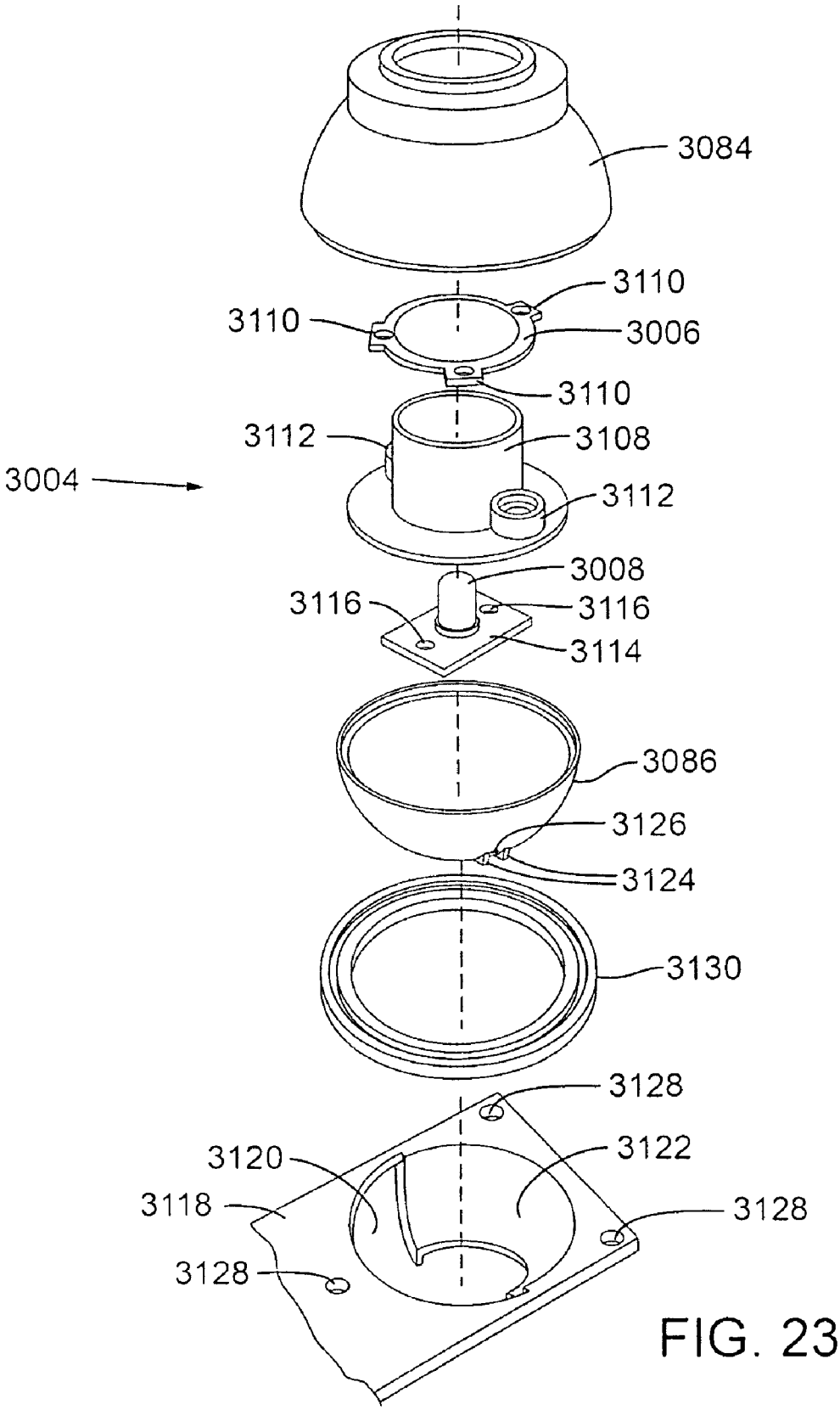
FIG. 23 is an exploded perspective view of one of the light source housings and associated components of the embodiment shown in FIG. 17, as viewed from the top and one side thereof.

FIG. 23 is an exploded perspective view showing one of the light source housings 3004 and associated components. As shown in FIG. 23, the window 3006 is positioned between an upper shell 3084 and an internal frame 3108. Three tabs 3110 around the perimeter of the window 3006 fit within corresponding recesses (not shown) on the inside surface of the upper shell 3084 to hold the window in place. When assembled, screws (not shown) extend through internal frame screw holes 3112 in the internal frame 3108 and into screw-receiving posts (not shown) within the upper shell 3084 to secure the internal frame to the upper shell. The lighting element 3008 is positioned on a plate 3114 and extends through an opening (not shown) in the bottom surface of the internal frame 3108. Additional screws (not shown) extend through plate screw openings 3116 in the plate 3114 and into and into screw-receiving posts (not shown) on the bottom surface of the internal frame 3108 to secure the plate to the internal frame. A lower shell 3086 connects to the upper shell 3084 to enclose the internal components of the light source housing 3004 within a substantially spherical housing.

The lighting device 3000 includes two support plates 3118 (one partially shown in FIG. 23), each including three light source housing openings 3120. A half dish 3122 extends below each light source housing opening 3120. When the lighting device 3000 is assembled, each light source housing 3004 extends through one of the light source housing openings 3120 and is cradled by the corresponding half dish 3122 such that, when the light source housing is positioned vertically, the top edge of the lower shell 3086 is approximately level with the top surface of the support plate 3118. The light source housing 3004 is free to swivel within the half dish 3122. The light source housing 3004 also can rotate around an axis perpendicular to the top surface of the support plate 3118, but only through a range of about 180 degrees. Further rotation is blocked when side projections 3124 extending from the lower shell 3086 contact the edges of the half dish 3122. Wires (not shown) extend through a wire opening 3126 between the side projections 3124 to connect the lighting element 3008 to battery compartments (not shown) within the base 3002.

When assembled, screws (not shown) extend through support plate screw holes 3128 in the support plates 3118 and into screw-receiving posts (not shown) within the base 3002 to secure the support plates to the base. A rubberized ring 3130 fits snugly around each light source housing 3004 between the corresponding support plate 3118 and an internal surface of the base 3002. Friction between the rubberized rings 3130 and the upper and lower shells 3084, 3086 helps to hold the light source housings 3004 in place after rotation relative to the base 3002. The diameters of the openings in the base 3002 through which the light source housings 3004 project are slightly smaller than the diameters of the substantially spherical portions of the light source housings. This prevents separation of the light source housings 3004 from the base 3002.

In the lighting devices 1000, 2000, 3000 illustrated in FIGS. 1-23, the bases 1002, 2002, 3002 are all are elongated and have substantially rectangular cross sections in planes perpendicular to their lengths. Other embodiments can have bases with different shapes. Some disclosed embodiments have bases that are not elongated. For example, these embodiments can have bases with top surfaces that are substantially round or substantially shaped as a non-elongated polygon, such as a square or a triangle. In embodiments having elongated bases, the bases can have cross sections in planes perpendicular to their lengths that substantially resemble, for example, a polygon (e.g., a parallelogram, a pentagon, a hexagon, a heptagon, or an octagon), a circle, an oval, or a circular segment (e.g., a semicircle). The lengths of the bases also can be straight or curved. In some disclosed embodiments, the bases have lengths that form one or more loops. The bases 1002, 2002, 3002 in the illustrated lighting device 1000, 2000, 3000 are made of plastic. In other embodiments, the bases can be made of another material, such as metal.

As discussed above with reference to the lighting device 1000, the base 1002 includes two battery compartments 1046. Each of the battery compartments 1046 is configured to hold three size AAA batteries with the long axis of each battery substantially perpendicular to the long axis of the base 1002. These battery compartments 1046 are configured so that installed batteries are electrically connected in series with soldered connections (not shown) at the beginning and end of the series. Wires (not shown) extend between the soldered connections of the separate battery compartments 1046 and between the soldered connections of the battery compartments and contacts on the backing plates 1012 of the light source housings 1004. The backing plates 1012 are connected to circuit boards (not shown) that control the flow of electricity to the lighting elements 2008. The lighting devices 2000, 3000 each include similarly configured battery compartments and associated wiring. Other embodiments can include different electrical configurations. Embodiments powered by batteries can include any number, type, and arrangement of batteries, such as two AA batteries in series or one nine-volt battery directly connected to the circuit. The batteries can be housed in one, two, three, four, or a greater number of battery compartments. For example, some disclosed embodiments include a battery compartment corresponding to each light source housing. Other embodiments can be hard wired to a permanent power source, such as a wall circuit. Still other embodiments can be plugged into a conventional electrical receptacle. These embodiments can include an electrical cord permanently or removably attached to the lighting device. Hard-wired and plug-in embodiments can include an adaptor to modify the voltage of a conventional wall circuit. Such an adaptor can be positioned, for example, within the base of the lighting device or along a cord attached to the lighting device.

The lighting devices 1000, 2000, 3000 illustrated in FIGS. 1-23 each include components for preventing excessive rotation of the light source housings 1004, 2004, 3004 around axis perpendicular to the bases 1002, 2002, 3002. This helps to prevent the wiring within the bases 1002, 2002, 3002 from becoming tangled or breaking from excess tension. Other embodiments can include different mechanisms or no mechanisms for protecting the wiring in this manner.

The lighting devices 1000, 2000 each include three light source housings 1004, 2004. The lighting device 3000 includes six light source housings 3004. Other embodiments can include one, two, three, four, five, six, seven, eight, nine, ten, or a greater number of light source housings. The light source housings 1004, 2004, 3004, in the illustrated lighting devices 1000, 2000, 3000 are evenly spaced in single rows along the lengths of the bases 1002, 2002, 3002. In other embodiments, the light source housings can have different arrangements. For example, the light source housings can be arranged in multiple rows, clusters, a staggered pattern, or a random pattern.

The windows 1006, 2006, 3006 of the illustrated lighting devices 1000, 2000, 3000 are made of clear plastic. Other embodiments can have windows made of glass or another substantially optically transmissive material. The majority of the inside surfaces of the windows 1006, 2006 of the lighting devices 1000, 2000 are coated to give them a slightly frosted appearance. The windows 1006, 2006 of the lighting devices 1000, 2000 also include uncoated regions directly above each of the individual lighting elements 1008, 2008. To promote the transmission of light, the lighting elements in embodiments of the disclosed lighting device can be mounted on reflective backings.

The light source housings 1004 of the lighting device 1000 each include four lighting elements 1008. The light source housings 2004 of the lighting device 2000 each include three lighting elements 2008. The light source housings 3004 of the lighting device 3000 each include one lighting element 3008. In other embodiments, each light source housing can include one, two, three, four, five, six, seven, eight, nine, ten, or a greater number of lighting elements. In embodiments that include multiple lighting elements per light source housing, the lighting elements can be arranged in a variety of configurations. For example, the lighting elements can be arranged in a circular configuration, in one or more rows that are substantially parallel to the long axis of the light source housing, or in one or more rows that are substantially perpendicular to the long axis of the light source housing. The lighting elements also can be arranged, for example, in clusters or in a staggered pattern.

In the illustrated lighting devices 1000, 2000, 3000, the lighting elements 1008, 2008, 3008 are white light-emitting diodes. In other embodiments the lighting elements can be incandescent, fluorescent, halogen, xenon, neon, or some other commercially available lighting type. Light-emitting diodes are particularly well suited for use in disclosed embodiments due to their compact size, low power demand, low heat output, long life, and high durability. Instead of white light-emitting diodes, other embodiments can include light-emitting diodes of another color, such as red, orange, yellow, green, or blue.

In the illustrated lighting devices 1000, 2000, 3000, the power buttons 1050, 2050, 3050 turn the lighting elements 1008, 2008, 3008 either on or off. Other embodiments can have a power button configured to toggle the lighting elements between different levels of light intensity. For example, a single press of the power button can turn on the lighting elements, a second press of the power button can increase the light intensity, and a third press of the power button can turn off the lighting elements. Alternatively, the power button can be configured to toggle between the activation of different numbers of lighting elements from among a plurality of lighting elements. For example, a single press of the power button can turn on the lighting elements within a single light source housing, a second press of the power button can turn on all of the lighting elements, and a third press of the power button can turn off all of the lighting elements. The functionality of toggling the light intensity or the number of illuminated lighting elements can be incorporated by including a commercially available dimmer or toggle switch on a circuit board electrically connected to the lighting elements. Instead of a power button, other embodiments can include another type of switch, such as a toggle switch or a rocker switch. Such switches can be positioned, for example, on a portion of the lighting device other than the front of the base, such as on the side of the base, on the end of the base, or on a separate unit connected to the base.

Embodiments of the disclosed lighting device can include a variety of features in addition to or in place of those described above and shown in FIGS. 1-23. For example, some embodiments include a sensor that activates and deactivates the lighting elements. In some embodiments, this sensor is a light sensor, such as a commercially available light sensor that activates the lighting elements when light from another source is detected. This can be useful for applications in which the disclosed lighting device is not the primary lighting device for an area. Once the primary lighting device for an area (e.g., an overhead light) is activated, embodiments of the disclosed lighting device can be configured to activate automatically. In this way, secondary lighting, such as accent lighting, can be activated without the need for manual intervention. By the same principle, the lighting device can be activated by a motion sensor, such as a commercially available motion sensor. Embodiments including a sensor also can include a manual override switch to deactivate the sensor when automatic operation is not desirable. The manual override switch can be, for example, a commercially available switch that switches the flow of electrical current between a circuit including the sensor and a circuit not including the sensor.

The features disclosed in the illustrated lighting devices 1000, 2000, 3000 can be interchanged to create additional embodiments. For example, two or more different light source housings from among the light source housings 1004, 2004, 3004 of the disclosed lighting devices 1000, 2000, 3000 can be combined on a single base. The functional features of the individual light source housings 1004, 2004, 3004 of the disclosed lighting devices 1000, 2000, 3000 also can be interchanged.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A lighting device, comprising:

a base;

a light source housing at least partially inset within the base; and a swivel arm connecting the light source housing to the base, wherein the swivel arm includes a head and a stem, the stem of the swivel arm is fixedly secured to an internal portion of the base, and the head of the swivel arm is at least partially captured within the light source housing such that the light source housing is prevented from separating from the base and the light source housing can swivel relative to the base on the head of the swivel arm, wherein the light source housing includes a lower shell portion, an upper shell portion, and a lighting-element backing plate positioned between the lower shell portion and the upper shell portion, the lighting-element backing plate has an upper surface and a lower surface, a lighting element is positioned on the upper surface of the lighting-element backing plate, the lower surface of the lighting-element backing plate has a rounded recess, and the rounded recess rests on an upper rounded portion of the head of the swivel arm.

2. The lighting device according to claim 1, wherein the light source housing is substantially shaped as an oblate spheroid.

3. The lighting device according to claim 1, wherein the base includes a battery compartment.

4. The lighting device according to claim 1, further comprising a mounting plate detachably connected to the base.

5. The lighting device according to claim 1, wherein the base is elongated and the lighting device includes three or more light source housings positioned along the long axis of the base.

6. The lighting device according to claim 1, wherein the cross section of the stem of the swivel arm in a plane perpendicular to the length of the swivel arm is not round and a portion of the stem of the swivel arm fits snugly into an opening in the internal portion of the base such that the swivel arm is prevented from rotating around an axis parallel to the length of the swivel arm.

7. The lighting device according to claim 1, further comprising means for restricting rotation of the light source housing relative to the base around an axis parallel to a length of the stem.

8. The lighting device according to claim 1, wherein the lower shell portion has an opening, the stem of the swivel arm extends through the opening, and a lower rounded surface of the head of the swivel arm contacts a rim adjacent to the opening.

9. The lighting device according to claim 8, wherein the lighting-element backing plate includes a circuit board, and the upper shell portion is at least partially transparent.

10. The lighting device according to claim 1, wherein the rounded recess extends into the lighting-element backing plate to form a projection on the upper surface of the lighting-element backing plate.

11. The lighting device according to claim 10, wherein three or more lighting elements are positioned on the upper surface of the lighting-element backing plate, the projection is substantially centered on the upper surface of the lighting-element backing plate, and the three or more lighting elements are distributed around the projection.

12. A lighting device, comprising:

a base; and a light source housing, wherein the light source housing has an upper shell portion including a window, a lower shell portion at least partially inset within the base and a lighting-element backing plate positioned between the upper shell portion and the lower shell portion, the light source housing is substantially shaped as an oblate spheroid with a half-toroid lower portion, a ball joint connects the light source housing to the base, the ball joint includes a ball fixed to one end of an elongated stem, and the elongated stem extends through an opening in the lower shell portion of the light source housing, and the ball is captured in a space between a rounded recess in the lighting-element backing plate and a rim adjacent to the opening in the lower shell portion of the light source housing.

13. The lighting device according to claim 12, wherein the opening in the lower shell portion is positioned at a narrow end of a tapered recess extending into an underside of the lower shell portion.

14. The lighting device according to claim 12, wherein the opening in the lower shell portion is substantially centered in the lower shell portion and the lower shell portion is substantially shaped as a half toroid.

15. The lighting device according to claim 12, wherein the ball includes a nub, the perimeter of the rounded recess in the lighting-element backing plate includes an upper notch, the rim adjacent to the opening in the lower shell portion includes a lower notch, the upper notch and the lower notch form a channel around the nub, and interaction between the channel and the nub restricts rotation of the light source housing around an axis parallel to a length of the stem.

16. The lighting device according to claim 12, wherein the ball includes four nubs evenly distributed around the ball in a plane substantially perpendicular to the length of the stem, the perimeter of the rounded recess in the lighting-element backing plate includes four upper notches, the rim adjacent to the opening in the lower shell portion includes four lower notches, each of the upper notches pairs with a lower notch to form a channel around one of the nubs, and interaction between the channels and the nubs restricts rotation of the light source housing around an axis parallel to a length of the stem.

17. The lighting device according to claim 12, wherein the base includes a battery compartment.

18. The lighting device according to claim 12, wherein the base is elongated and the lighting device includes three or more light source housings positioned along the long axis of the base.

19. The lighting device according to claim 12, further comprising means for restricting rotation of the light source housing relative to the base around an axis parallel to a length of the elongated stem.

20. A lighting device, comprising:

a base including a battery compartment;

a light source housing at least partially inset within the base; and a swivel arm connecting the light source housing to the base, wherein the light source housing is substantially shaped as an oblate spheroid, the swivel arm includes a head and a stem, the stem of the swivel arm is fixedly secured to an internal portion of the base, the head of the swivel arm is at least partially captured within the light source housing such that the light source housing is prevented from separating from the base and the light source housing can swivel relative to the base on the head of the swivel arm, the light source housing includes a lower shell portion, an upper shell portion, and a lighting-element backing plate positioned between the lower shell portion and the upper shell portion, the head of the swivel arm is captured in a space between a rounded recess in the lighting-element backing plate and a rim adjacent to an opening in the lower shell portion, the stem of the swivel arm extends through the opening in the lower shell portion, and the opening is positioned at a narrow end of a tapered recess extending into an underside of the lower shell portion.

* * * * *